US008622144B2

(12) United States Patent
Davis et al.

(10) Patent No.: US 8,622,144 B2
(45) Date of Patent: Jan. 7, 2014

(54) METHOD OF, AND APPARATUS FOR THE DISPENSING OF DECONTAMINANTS AND FIRE SUPPRESSANT FOAM

(75) Inventors: John Davis, Fort Erie (CA); Dragan Sorak, Burlington (CA)

(73) Assignee: Allen-Vanguard Corporation, Ottawa (CA)

( * ) Notice: Subject to any disclaimer, the term of this patent is extended or adjusted under 35 U.S.C. 154(b) by 855 days.

(21) Appl. No.: 12/262,681

(22) Filed: Oct. 31, 2008

(65) Prior Publication Data

US 2009/0145615 A1 Jun. 11, 2009

Related U.S. Application Data

(60) Provisional application No. 60/984,196, filed on Oct. 31, 2007.

(51) Int. Cl.
*A62C 2/00* (2006.01)
*A62C 3/00* (2006.01)
*A62C 35/00* (2006.01)

(52) U.S. Cl.
USPC ..... 169/44; 169/62; 169/14; 239/146; 239/303; 239/10

(58) Field of Classification Search
USPC ..... 169/44, 62, 13, 14, 15, 16; 239/146, 239/147, 148, 172, 722, 749, 302, 303, 304, 239/305, 307, 310, 398, 399, 461, 463, 469, 239/1, 10
See application file for complete search history.

(56) References Cited

U.S. PATENT DOCUMENTS

| | | | | |
|---|---|---|---|---|
| 5,803,596 | A * | 9/1998 | Stephens | 366/10 |
| 6,155,351 | A * | 12/2000 | Breedlove et al. | 169/14 |
| 6,405,626 | B1 * | 6/2002 | Bureaux et al. | 86/50 |
| 2006/0231644 | A1 * | 10/2006 | Breedlove et al. | 239/398 |

* cited by examiner

*Primary Examiner* — Justin Jonaitis
(74) *Attorney, Agent, or Firm* — McMillan LLP

(57) ABSTRACT

This invention comprises a method of dispensing water-based decontaminants from a dispenser, comprising the steps of: (a) filling one or more tanks each with respective solutions of chemicals and water; (b) pumping the solutions from the tanks in respective hoses, each of the tanks being evacuated under the urging of a respective pump; (c) mixing the solutions at a static mixer after evacuation of the solutions from the tanks to form a mixture; (d) adding water to the mixture at the static mixer; and (e) dispensing the water-added mixture onto an incident site.

1 Claim, 4 Drawing Sheets

METHOD OF, AND APPARATUS FOR THE DISPENSING OF DECONTAMINANTS AND FIRE SUPPRESSANT FOAM

FIELD OF INVENTION

The present invention relates to the field of CBRN (Chemical, Biological, Radiological, and Nuclear) decontamination and fire depressant foam dispensing equipment, and more particularly, to neutralizing chemical and biological threats and to the removal of radiological particles.

BACKGROUND OF THE INVENTION

Decontaminant dispensing equipment was formerly developed solely for the dispensing of a particular decontaminant, rather than multiple different decontaminants, a fact which severely limited the ability of one military or civil service to work jointly with another, due to issues of incompatibility. For example, large scale decontaminant dispensing systems were not designed with the capability of discharging fire suppressant foams.

The area coverage of CBRN decontaminant dispensing equipment—i.e., the area to which CBRN decontaminants or fire-suppressants could be effectively deployed by particular pieces of equipment—has also been limited by the size (more particularly the surface area, or "foot print" effectively occupied by such equipment) of the mechanical device. This was mainly due to the large capacity of liquid required when using the dispensing units.

In view of the foregoing shortcoming of prior devices, fire depressant foam is typically dispensed from fire services pump trucks designed solely for that purpose, which are large and heavy vehicles. The mere size and weight of these vehicles inhibits their ability to access many locations which may require their employment.

The limited versatility of prior art devices meant that, for example, removal of radiological particles could be interrupted as systems were shut down to be recharged with the particular decontamination solutions used to trap and pull these particles from where they rested. This increased the chance of these particles being transported to other locations downwind of the contaminated site, and also increased the time required to perform the operation.

SUMMARY OF THE INVENTION

It is an object of the invention to provide an improved method of dispensing decontaminants. It is a further object of the present invention to provide a system that is capable of performing other tasks normally requiring additional equipment. It is also the intent to develop a system that can be employed in the interior of airports, military structures, shopping malls and other enclosed spaces to aide in chemical, biological, and radiological events as well as the suppression of fire.

The present invention provides for the following four improvements in conventional CBRN dispensing equipment: 1) the dispensing of most commercial aqueous decontaminants; 2) a much larger area of coverage while maintaining a foot print equal to or less than conventional equipment; 3) the ability to dispense fire suppressant foam on a continual basis in areas unattainable to presently employed equipment; and 4) the capability of continuous radiological particle removal.

For example, the dispensing of most commercial aqueous decontaminants is accomplished by a simple hand adjustment to the flow control valve to assure the proper water to chemical solution ratio and the correct choice of nozzle. The presence of two liquid tanks and separate pumps allows for the employment of decontaminant solutions that because of issues regarding pot life and/or stability must not be brought together or activated until the time of application. In other applications such as 0.5% bleach and water the solution is mixed in both tanks. This invention has the capability of dispersing many other decontaminant solutions that are similar to the two decontaminants listed and therefore there requirements for dispensing are similar.

Additionally, a larger area of coverage while maintaining or reducing the foot print of the dispensing equipment is accomplished by mixing the two liquid tanks close to saturation and running free water through the system from a hydrant, pump truck or portable pump.

Another advantage is the ability to dispense fire suppressant foam on a continual basis in areas unattainable to presently employed equipment. This is made possible by the light weight and relatively small footprint of the system. This invention has a dry weight of approximately 317 Kg (700 lbs.) and a charged weight of approximately 1225 Kg (2700 lbs.) with a foot print of 1.22 m (4 ft.)×2.44 m (8 ft.). The light weight and small foot print allows the system to be transported in the box of a regular sized pick up truck or to be placed on wheels making it mobile for use within the interior of large buildings such as airports and malls.

Still another advantage is the capability of continuous radiological particle removal. This is made possible by the fact that this invention was designed with separate chemical tanks evacuated by separate pumps having their own set of controls. This allows the operating speed of each pump to be increased or decreased depending on the requirements of the operation. Another factor making this operation possible is the system size and its potential mobility.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION OF A PREFERRED EMBODIMENT

An exemplary apparatus for implementing the invention will be described with respect to the embodiments appearing in FIGS. 1-5. A partial parts list of the components used in these embodiments is summarized in the following list:

Decontaminant Dispenser Materials List

| ITEM | DESCRIPTION |
|---|---|
| 1 | PALLET |
| 2 | TANK "A" |

-continued

Decontaminant Dispenser Materials List

| ITEM | DESCRIPTION |
|---|---|
| 3 | TANK "B" |
| 4 | FILL PIPE "A" |
| 5 | FILL PIPE "B" |
| 6 | INLET LINE |
| 7 | PUMP "A" |
| 8 | PUMP "B" |
| 9 | SUCTION HOSE "A" |
| 10 | SUCTION HOSE "B" |
| 11 | DISCHARGE HOSE "A" |
| 12 | DISCHARGE HOSE "B" |
| 13 | FLOW METER-DISCHARGE HOSE "A" |
| 14 | FLOW METER-DISCHARGE HOSE "B" |
| 15 | FLOW CONTROL VALVE |
| 16 | FLOW METER |
| 17 | STATIC MIXER |
| 18 | OUTLET LINE |
| 19 | AIR CYLINDER |
| 20 | CONTROL PANEL |
| 21 | MANIFOLD |
| 22 | AIR PRESSURE GAUGE-FIRST STAGE |
| 23 | PRESSURE REGULATOR-AIR LINE "A" |
| 24 | PRESSURE REGULATOR-AIR LINE "B" |
| 25 | AIR PRESSURE GAUGE SECOND STAGE |
| 26 | SHUT OFF VALVE-AIR LINE "A" |
| 27 | SHUT OFF VALVE-AIR LINE "B" |
| 28 | AIR LINE "A" |
| 29 | AIR LINE "B" |
| 30 | 1½" HOSE |
| 31 | NOZZLE |

Figure 1:
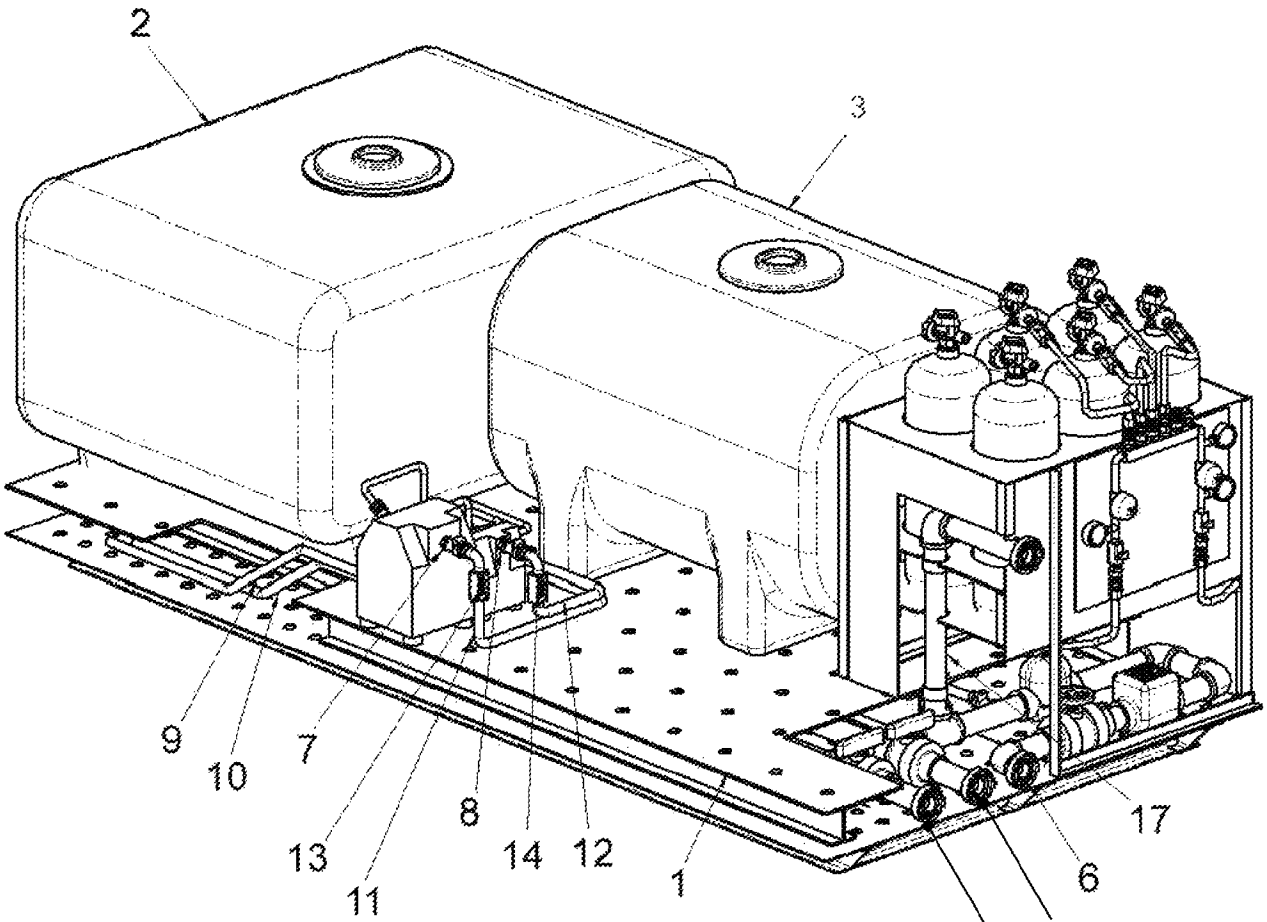
FIG. 1 is a front right perspective view from above of a system according to the present invention.
Figure 2:
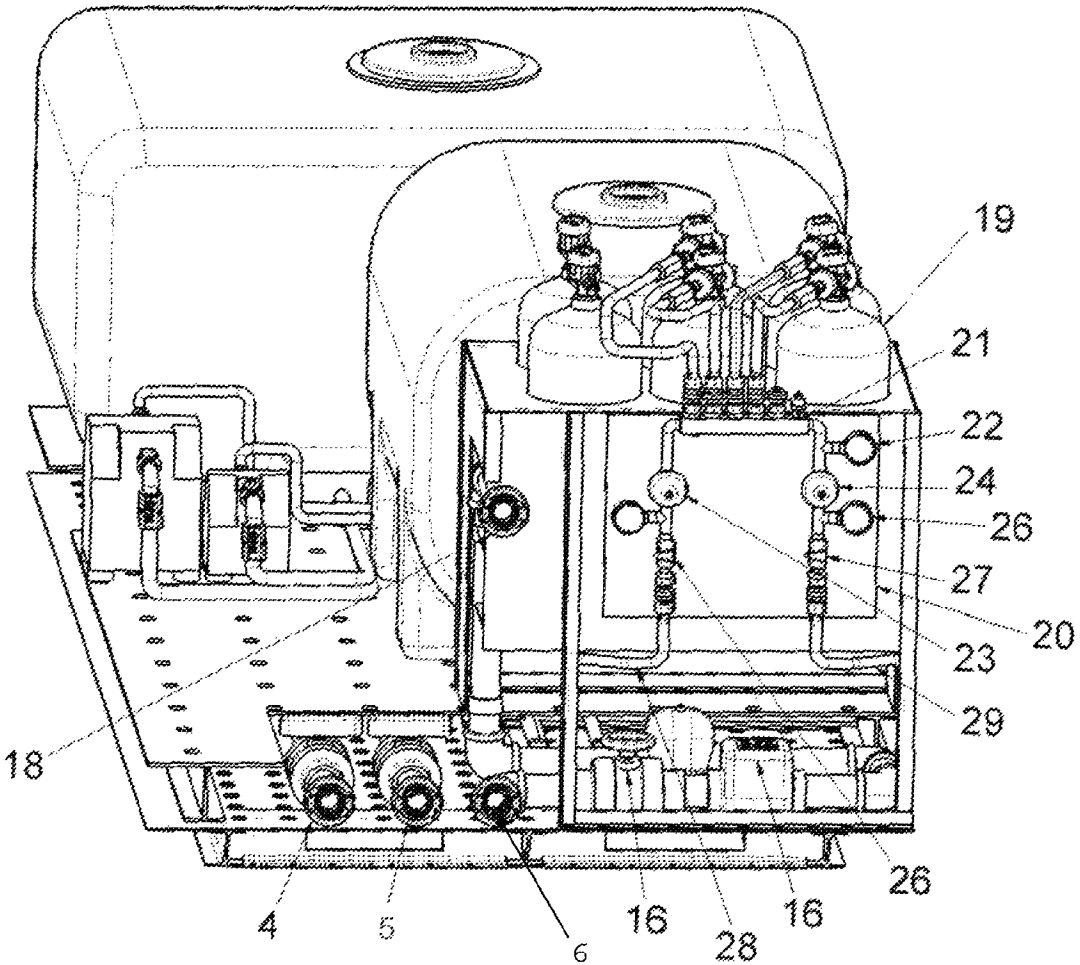
FIG. 2 is an enlarged right side perspective view of the system of FIG. 1.
Figure 3:
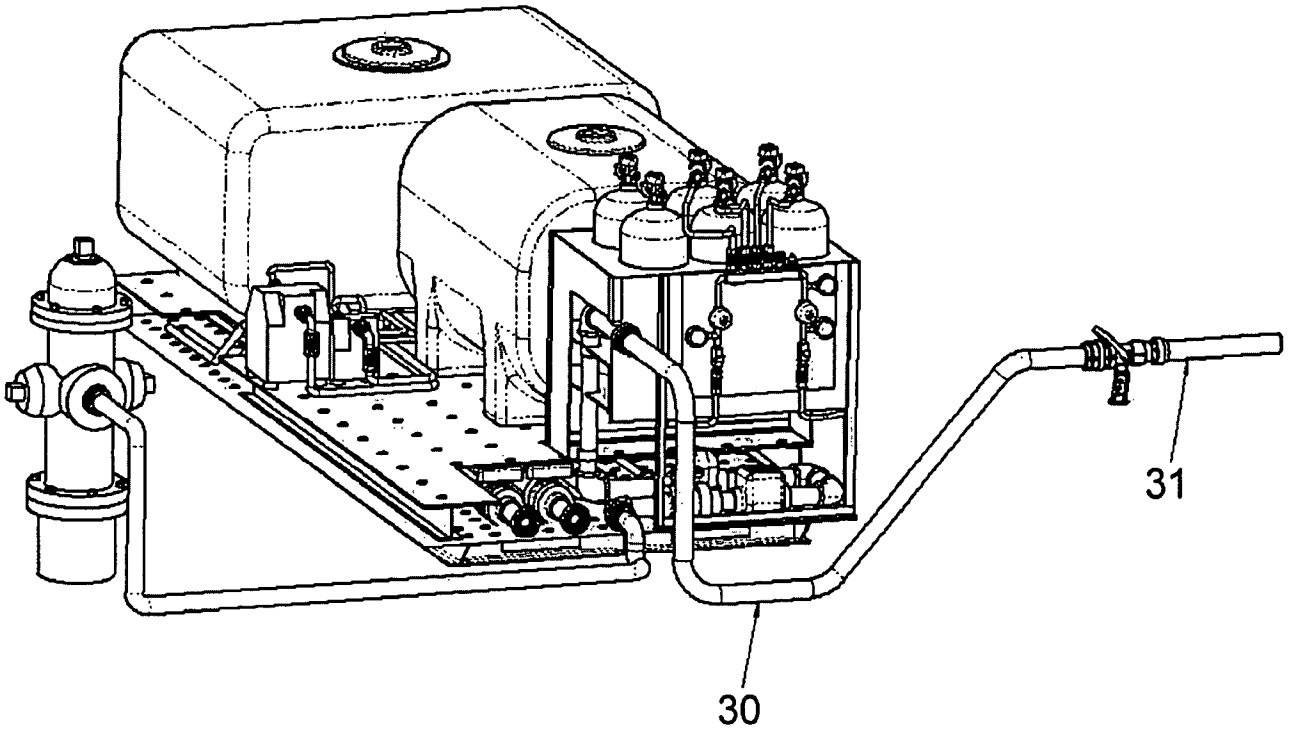
FIG. 3 is a right side perspective view of the system of FIG. 1, shown connected by an out hose to a fire hydrant.
Figure 4:
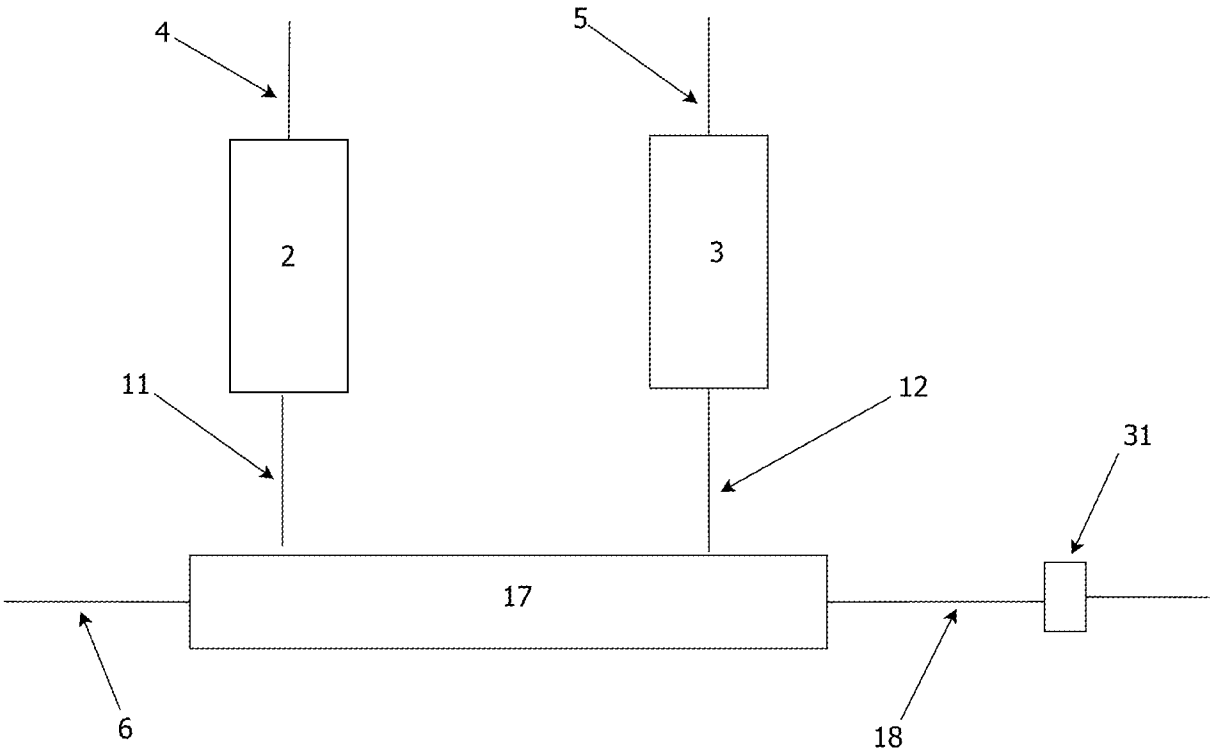
FIG. 4 is a schematic representation of certain elements of the system of FIG. 1.

Referring to FIGS. 1-4, in the event of a chemical or biological decontamination requirement the decontaminant dispenser would be prepared for operation in the following manner: one end of a length of 1½" hose (30) would be connected to a water source (hydrant, pump truck, portable pump) and the other end would be connected to fill pipe "A" (4). Tank "A" (2) is filled with the appropriate solution of the active decontaminant chemical and water. The end of the 1½" hose (30) is removed from fill pipe "A" (4) and connected to fill pipe "B" (5). Tank "B" (3) is then filled with the appropriate solution of decontaminant buffer and water. The end of the 1½" hose (30) is now removed from fill pipe "B" (5) and connected to inlet line (6) an additional length of 1½" hose (30) is now connected to outlet line (18) and nozzle (31) is connected to the opposite end of this length of 1½" hose (30). Air cylinders (19) are connected to manifold (21) on the control panel (20). As water passes through inlet line (6) its flow is controlled by flow control valve (15) and adjusted to the proper flow by reading the digital read out on flow meter (16). Shut off valve-air line "A" (26) is turned to the "ON" position causing pressurized air to flow through air line "A" (28) and starting pump "A" (7). Shut off valve-air line "B" (27) is turned to the "ON" position causing pressurized air to flow through air line "B" (29) and starting pump "B" (8). Pump "A" (7) and Pump "B" (8) pump the solution from tank "A" (2) and tank "B" (3) through discharge hose "A" (11) and discharge hose "B" (12). These two solutions are pumped through static mixer (17) were they mix with the free water entering the system through inlet line (6). The combined solutions then pass through outlet line (18) through 1½" hose (30) and out nozzle (31) as decontaminant foam. FIG. 4 schematically shows the flow path of the water and the chemicals referred to above. Various elements have been omitted from FIG. 4 for ease of understanding, including pumps, valves and other hardware elements otherwise shown in FIGS. 1 to 3.

In the event that this system is required to be employed to dispense fire suppressant foam the following preparation would be required. One end of a length of 1½" hose (30) would be connected to a water source (hydrant, pump truck, portable pump) and the other end would be connected to fill pipe "B" (5). Tank "B" (3) would be filled with the appropriate solution of chemical fire suppressant. The end of the 1½" hose (30) is now removed from fill pipe "B" (5) and connected to inlet line (6) an additional length of 1½" hose (30) is now connected to outlet line (18) and nozzle (31) is connected to the opposite end of this length of 1½" hose (30). Air cylinders (19) are connected to manifold (21) on the control panel (20). As water passes through inlet line (6) its flow is controlled by flow control valve (15) and adjusted to the proper flow by reading the digital read out on flow meter (16). Shut off valve-air line "B" (27) is turned to the "ON" position causing pressurized air to flow from manifold (21) through pressure regulator-air line "B" (24). The operational speed of pump "B" (8) and thus the flow of solution from tank "B" (3) is controlled by adjusting pressure regulator-air line "B" (24) this flow can be read off the digital display on flow meter-discharge hose "B" (14). The solution is pumped through pump "B" (3) and into discharge hose "B" (12). The fire suppressant solution continues to be pumped through static mixer (17) where it mixes with the free water entering the system through inlet line (6). The combined solutions then pass through outlet line (18) through 1½" hose (30) and out nozzle (31) as fire suppressant foam.

A radiological particle removal operation requires the decontaminant dispenser to be set up in the following manner; one end of a length of 1½" hose (30) would be connected to a water source (hydrant, pump truck, portable pump) and the other end would be connected to fill pipe "B" (5). Tank "B" (3) would be filled with the appropriate solution of chemical. The end of the 1½" hose (30) is now removed from fill pipe "B" (5) and connected to inlet line (6) an additional length of 1½" hose (30) is now connected to outlet line (18) and nozzle (31) is connected to the opposite end of this length of 1½" hose (30). Air cylinders (19) are connected to manifold (21) on the control panel (20). As water passes through inlet line (6) its flow is controlled by flow control valve (15) and adjusted to the proper flow by reading the digital read out on flow meter (16). Shut off valve-air line "B" (27) is turned to the "ON" position causing pressurized air to flow from manifold (21) through pressure regulator-air line "B" (24). The operational speed of pump "B" (8) and thus the flow of solution from tank "B" (3) is controlled by adjusting pressure regulator-air line "B" (24) this flow can be read off the digital display on flow meter-discharge hose "B" (14). The solution is pumped through pump "B" (3) and into discharge hose "B" (12). The radiological particle removal solution continues to be pumped through static mixer (17) where it mixes with the free water entering the system through inlet line (6). The combined solutions then pass through outlet line (18) through 1½" hose (30) and out nozzle (31) as the appropriate foam.

Area Decontamination or Containment Foams

Area decontamination and containment foams are used where Chemical, Biological, Radiological or other hazardous materials have been discovered.

The Decontamination or Containment Foam is applied over the contaminated area eliminating the risk of further air born particles, and neutralizing chemical and biological agents.

Scenario #1: mixing, storage and dispensing of Decontamination Foams. To increase the pot life of many Decontamination Foams it has been determined that the active ingredient must be kept separate from the buffer until the time of application. To that extent this invention allows the mixing of the active ingredient and water in Tank "A" and the mixing of the buffer and water in Tank "B" to a much higher concentration than would be normally applied. This allows for a much longer Ready for Use storage life, giving the CBRN Response Team a preparedness capability never before imagined, and decreasing costs for spoiled supplies. As the ratios between tanks "A" and "B" are pre-set in accordance with the decontaminant employed, application is accomplished by simply adjusting the flow of water from the hydrant to a predetermined ratio, opening the nozzle, and turning the pumps to tanks "A" and "B" to the "ON" position.

Scenario #1 from above has the foam decontaminant ready for application. In this scenario, two tanks are employed, the capacity of Tank "A" is 682 litres and the capacity of Tank "B" is 455 litres. Tank "A" and "B" are evacuated at a combined rate of 28.5 litres per minutes while free water is pumped through the system at a rate of 40 litres per minutes for a total of 68.5 litres per minute. The solutions from the two tanks are pumped into the flow of free water. These three liquids continue to mix as they travel through the network of piping, static mixer, hose and finally the foam nozzle. A fully charged system with the above mentioned tank capacities would normally produce an area coverage of 1137 $m^2$. This invention will produce an area coverage equaling two times that or 2271 $m^2$ while maintaining its original foot print.

Scenario #2: mixing, storage and dispensing of a decontaminant consisting of 0.5% bleach and water solution. In this scenario Tank "A" is filled with a bleach and water solution ten times greater (5%) than would normally be mixed. The solution can be stored within the system for several hours. As the pump evacuating Tank "A" has been pre-set to this type of decontaminant it is only a matter of regulating the ratio of free water (from the hydrant) to the correct flow, placing the correct nozzle (in the "ON" position) on the outlet hose and turning Pump "A" to the on position.

Scenario #2 from above utilizes a 0.5% solution of bleach and water. We have for the purpose of this illustration increased that solution to 5% bleach and water. Tank "A" having a capacity of 682 litres is evacuated at a rate of 13.5 litres per minute while free water is pumped through the system at a rate of 54.5 litres per minute for a total of 68 litres per minute. The solution from Tank "A" is pumped into the flow of free water. These two liquids continue to mix as they travel through the network of piping, static mixer, hose and finally the nozzle. A system with only Tank "A" charged would normally produce sufficient decontaminant to cover an area of 682 $m^2$. This invention will produce an area coverage equaling 5 times that or 3434 $m^2$ while maintaining its original foot print. If the contaminated area is larger than 3434 $m^2$ Tank "B" may also be charged while dispensing Tank "A" giving this system the capability of continuous operation while producing five times the area coverage of conventional equipment.

Scenario #3: a fire in an area inaccessible to a Fire Services Pump Truck. The fire is in the paint shop of a major manufacturer and the only access is a narrow roadway between two buildings. This system is designed to fit in the box of a pick up truck which is driven between the buildings and properly located. The free water hose is connected to the fire hydrant and the dispensing system inlet. Fire suppressant foam is poured into "B" Tank which holds sufficient water to reduce the viscosity of the suppressant to a manageable level. The operating air to "B" Pump is adjusted to allow the proper flow of suppressant to be pumped into the outlet line. The free water flow is adjusted to the correct proportion by the flow control valve and read out on the Digital Flow Meter. The surfactant mixes with the free water as they travel through the network of piping, static mixer, hose and finally the foam nozzle. If it is decided that additional foam will be required "A" Tank can be charged in the same manner as "B" Tank while the foam from "B" Tank is applied to the fire. This can be done on a rotating basis giving this invention a continuous fire fighting capability.

Scenario #4: a fire breaks out in the baggage handling area of a large airport. The decontaminant dispensing system is wheeled to the area and properly located. The free water hose is connected to the fire fighting station and the system inlet. Fire suppressant foam is poured into "B" Tank which holds sufficient water to reduce the viscosity of the suppressant to a manageable level. The operating air to "B" Pump is adjusted to allow the proper flow of suppressant to be pumped into the outlet line. The free water flow is adjusted to the correct proportion by the flow control valve and read out on the Digital Flow Meter. The surfactant mixes with the free water as they travel through the network of piping, static mixer, hose and finally the foam nozzle. If it is decided that additional foam will be required "A" Tank can be charged in the same manner as "B" Tank while the foam from "B" Tank is applied to the fire. This can be done on a rotating basis giving the system a continuous fire fighting capability.

Chemical and Biological Surface Decontamination

In the case of military-type chemical or biological threats, the decontamination solution will neutralize the contaminating agent after application and stated contact time. In the case of other hazardous materials, foams can be used to contain dangerous off gassing to reduce further contamination of the surrounding area. The decontaminant dispenser in this instance is primarily used as a high capacity CBRN (Chemical, Biological, Radiological, and Nuclear) clean-up tool. It does however, have multiple uses as demonstrated through out this application.

Scenario #5: there has been a leak at a nuclear plant requiring radiological particles to be removed from interior surfaces. This can be accomplished by wheeling the system through the plant to the location requiring clean up. The free water hose is connected to the fire fighting station and to the "B" Tank inlet. The tank is filled to the appropriate level and topped off with GCE 2000. The nozzle is opened and the free water hose is then connected to the inlet of the mixing line. The free water flow is corrected to the proper proportion and the "B" Pump is turned "ON". The foam is sprayed over the affected area trapping the radiological particles making them accessible for clean up. A defoamer, such as the Allen-Vanguard Defoamer is then employed to remove the foam capturing the radiological particles with it. This process continues until the readings within the plant are within tolerable limits. If a decision is made that the amount of foam in "B" Tank is insufficient, "A" Tank may be charged while "B" Tank is being evacuated. This can be done on a revolving basis giving this invention the capability of being employed on a continuous basis for the removal of radiological particle removal.

The present invention has been described with regard to one or more embodiments. However, it will be apparent to persons skilled in the art that a number of variations and modifications can be made without departing from the scope of the invention as defined in the appended claims.

We claim:

1. A method of dispensing water-based decontaminants from a dispenser, comprising the steps of:

(a) connecting one end of a hose to a water source external to the dispenser;

(b) connecting the other end of said hose to at least one first tank holding an active decontaminant chemical to provide a first solution of said active decontaminant chemical and water;

(c) disconnecting said other end of said hose from said at least one first tank and connecting said other end of said hose to at least one second tank holding a decontaminant buffer to provide a second solution of said decontaminant buffer and water;

(d) disconnecting said other end of said hose from said at least one second tank and connecting said other end of said hose to a static mixer;

(e) pumping the solutions from said first and second tanks in respective hoses with first and second pumps to said static mixer;

(c) mixing the first and second solutions at a static mixer to form a mixture;

(d) adding water to the mixture at the static mixer from said other end of said hose; and (e) dispensing the water-added mixture as a foam onto an incident site by passing the water-added mixture through a nozzle to convert the water-added mixture into a foam.

* * * * *